US009683306B2

(12) United States Patent
Kroener et al.

(10) Patent No.: US 9,683,306 B2
(45) Date of Patent: Jun. 20, 2017

(54) METHOD OF FORMING A COMPOSITE MATERIAL AND APPARATUS FOR FORMING A COMPOSITE MATERIAL

(71) Applicant: Infineon Technologies AG, Neubiberg (DE)

(72) Inventors: Friedrich Kroener, Villach (AT); Ingo Muri, Villach (AT)

(73) Assignee: Infineon Techologies AG, Neubiberg (DE)

( * ) Notice: Subject to any disclaimer, the term of this patent is extended or adjusted under 35 U.S.C. 154(b) by 77 days.

(21) Appl. No.: 14/467,106

(22) Filed: Aug. 25, 2014

(65) Prior Publication Data

US 2016/0053397 A1 Feb. 25, 2016

(51) Int. Cl.

| | |
|---|---|
| ***C25D 15/00*** | (2006.01) |
| ***C25D 5/02*** | (2006.01) |
| ***C25D 5/18*** | (2006.01) |
| ***C25D 5/34*** | (2006.01) |
| ***C25D 17/00*** | (2006.01) |
| ***C25D 5/10*** | (2006.01) |
| *C25D 3/12* | (2006.01) |

(Continued)

(52) U.S. Cl.

CPC ..... *C25D 15/00* (2013.01); *C25D 5/02* (2013.01); *C25D 5/10* (2013.01); *C25D 5/18* (2013.01); *C25D 5/34* (2013.01); *C25D 17/00* (2013.01); *C25D 17/001* (2013.01); *C25D 3/12* (2013.01); *C25D 3/38* (2013.01); *C25D 3/46* (2013.01); *C25D 3/48* (2013.01); *C25D 5/022* (2013.01); *C25D 21/10* (2013.01)

(58) Field of Classification Search

USPC ..... 205/109, 110

See application file for complete search history.

(56) References Cited

U.S. PATENT DOCUMENTS 5,283,116 A * 2/1994 Tomari ..... B41F 22/00 428/208
5,989,405 A * 11/1999 Murata ..... B24B 53/017 205/110

(Continued)

FOREIGN PATENT DOCUMENTS

| | | |
|---|---|---|
| DE | 69900286 T2 | 6/2002 |
| WO | 9940241 A2 | 8/1999 |

OTHER PUBLICATIONS

Hovestad et al, Electrochemical codeposition of inert particles in a metallic matrix, Jounral of Applied Electrochemistry, Jun. 1995, vol. 25, Issue 6, pp. 519-527.*

(Continued)

*Primary Examiner* — Harry D Wilkins, III

(74) *Attorney, Agent, or Firm* — Viering, Jentschura & Partner mbB

(57) ABSTRACT

A method of forming a composite material is provided. The method may include: arranging a suspension in physical contact with a carrier, wherein the suspension may comprise an electrolyte and a plurality of particles of a first component of the composite material; causing the particles of the first component of the composite material to sediment on the carrier, wherein a plurality of spaces may be formed between the sedimented particles; and forming by electroplating a second component of the composite material from the electrolyte in at least a fraction of the plurality of spaces.

14 Claims, 10 Drawing Sheets

(51) Int. Cl.

| | |
|---|---|
| *C25D 3/38* | (2006.01) |
| *C25D 3/46* | (2006.01) |
| *C25D 3/48* | (2006.01) |
| *C25D 21/10* | (2006.01) |

(56) References Cited

U.S. PATENT DOCUMENTS 6,010,610 A * 1/2000 Yih ..... C25D 7/006 205/149
6,376,098 B1 * 4/2002 Shaikh ..... C22C 47/00 164/97
6,699,379 B1 * 3/2004 Ke ..... C25D 3/562 205/109
7,731,832 B2 * 6/2010 Yamaguchi ..... B24D 3/10 205/110
8,025,783 B2 * 9/2011 Hellmund ..... H01L 29/4966 205/109
8,673,445 B2 * 3/2014 Sato ..... C25D 15/02 423/447.2
2004/0154925 A1 * 8/2004 Podlaha ..... C25D 15/02 205/104
2005/0109626 A1 * 5/2005 Kruger ..... C25D 5/00 205/102
2007/0251088 A1 * 11/2007 Susaki ..... C25D 7/04 29/830
2008/0131658 A1 6/2008 Wakharkar et al.
2011/0284387 A1 * 11/2011 Koizumi ..... C09D 7/1216 205/109
2014/0057127 A1 2/2014 Kroener

OTHER PUBLICATIONS

Feng et al, Electroless plating of carbon nanotubes with silver, Journal of Materials Science, May 2004, vol. 39, Issue 9, pp. 3241-3243.*
Publication of the Austrian Research Centers Seibersdorf "Materials and Production Engineering", 2000, 15 pages.

* cited by examiner

501

502

700

702

701

800

801

900

- short pitch-type carbon fibers (copper plated)
- short pitch-type carbon fibers (mixed)
- short PAN-type carbon fibers (copper plated)
- short PAN-type carbon fibers (mixed)
- long PAN-type carbon fibers (copper plated)
- infiltration of carbon fiber felts
- copper

901

METHOD OF FORMING A COMPOSITE MATERIAL AND APPARATUS FOR FORMING A COMPOSITE MATERIAL

TECHNICAL FIELD

Various embodiments relate generally to a method of forming a composite material and to an apparatus for forming a composite material.

BACKGROUND

A semiconductor device may include several different materials in order to benefit from differences in their properties, for example in physical parameters like electrical and/or thermal conductivity. By way of example, a semiconductor may be combined with a metal structure in order to exploit their difference in electrical conductivity, e.g. a (relatively thick) conductive metal layer, for example a copper layer, may be arranged on a semiconductive silicon wafer. The parameter that may mainly be exploited in the material combined with the semiconductor may be referred to as a primary parameter.

However, the differences in properties may incur problems during manufacture and/or use of the semiconductor device. For example, the different materials, e.g. the copper and the silicon, may differ in their coefficients of thermal expansion (CTE). A temperature change of the semiconductor device may thus lead to mechanical tension in the device, and eventually a defect may occur in the device, for example due to a break in one of the materials or in the connection between the two materials.

The metal layer may be formed in a way that makes it more flexible, such that it can follow the thermal expansion of the silicon, for example by making the layer thin and/or porous (e.g. using plasma deposition or porous printing). However, the electrical (and thermal) conductivity and the heat capacity of such layers is usually much lower than that of solid thick metal layers.

As an alternative that aims at preserving desired properties (e.g. high electrical and/or thermal conductivity) as much as possible, while bridging the undesired differences in properties (e.g. having a coefficient of thermal expansion between those of the metal and the semiconductor), a composite material may be provided, for example instead of the solid, thick metal layer.

Typically, composite materials, for example a composite material comprising copper and carbon, may be formed by means of sintering, for example using high pressure and high temperature. However, it may not be possible to perform a sintering process on a carrier such as a silicon wafer, for example a processed and/or structured silicon wafer, without damaging the carrier through the high pressures and temperatures involved.

SUMMARY

A method of forming a composite material is provided. The method may include: arranging a suspension in physical contact with a carrier, wherein the suspension may include an electrolyte and a plurality of particles of a first component of the composite material; causing the particles of the first component of the composite material to sediment on the carrier, wherein a plurality of spaces may be formed between the sedimented particles; and forming by electroplating a second component of the composite material from the electrolyte in at least a fraction of the plurality of spaces.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1A:
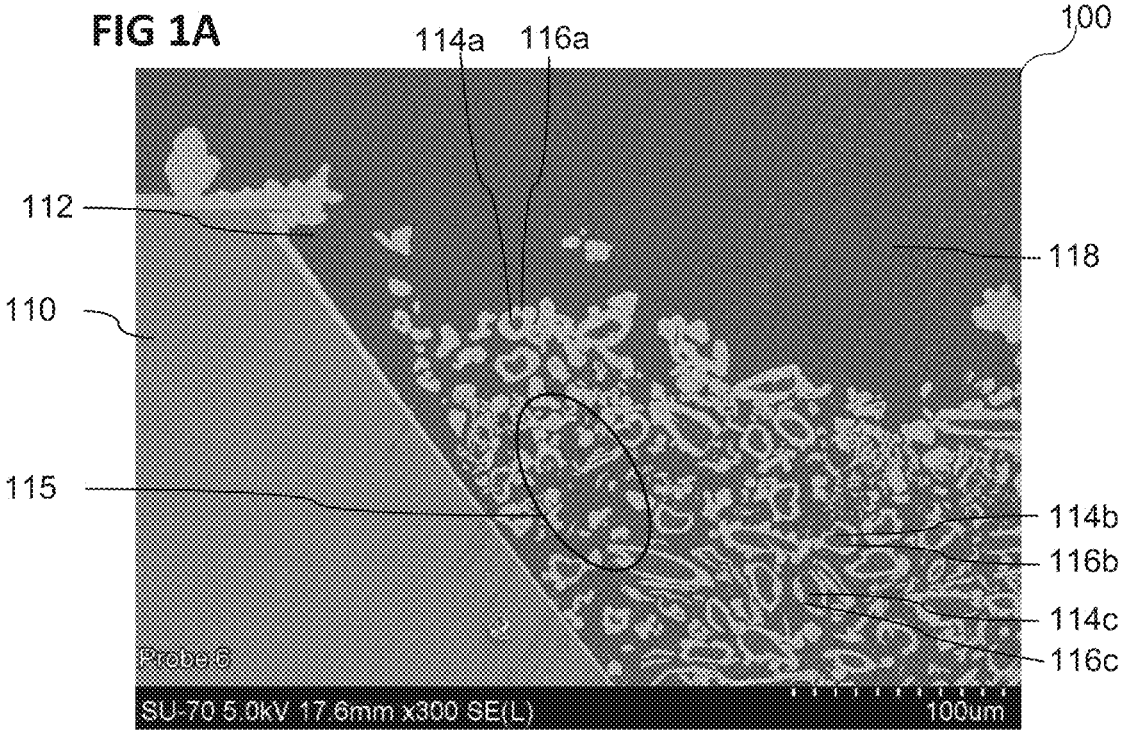
FIG. 1A to FIG. 1C show contour plots of polished cut images of carbon-copper-composite materials.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

The term "suspension" as used herein may be understood to mean a heterogeneous mixture of solid particles and a liquid, wherein the solid particles may be dispersed throughout the liquid and may be sufficiently large and/or differ sufficiently in density for sedimentation to occur. The heterogeneity may refer to components of the suspension, i.e. the solid particles and the liquid, being heterogeneous, whereas a spatial distribution of the solid particles in the liquid may be homogeneous.

The term "sedimentation" as used herein may be understood to mean a tendency for solid particles in a suspension to settle out of a liquid in which they are entrained, and come to rest against a barrier. This may be due to their motion through the liquid in response to forces acting on them: these forces may for example be gravity, centrifugal acceleration or buoyancy. In other words, in a situation where the suspension is arranged on a lower barrier, the particles may sediment out of the suspension by settling onto the lower barrier following gravitational force, for example if the density of the particles is higher than that of the liquid; in a situation where a (for example additional) top barrier is arranged on top or at the top of the liquid, the particles may sediment out of the suspension by settling onto the top barrier following buoyancy, for example if the density of the particles is lower than that of the liquid; and in a situation where the liquid is surrounded by a barrier, for example as side walls of a container, and the liquid or the combination of liquid and container are subjected to centrifugal force, for example by means of rotating the liquid (and optionally the container), the particles may sediment out of the suspension by settling onto the surrounding barrier following centrifugal force, for example if the density of the particles is higher than that of the liquid.

The terms electrodeposition, electroplating and galvanizing may be used as synonyms herein and may be understood to refer to a process in which an electrical current in an electrolyte is used to deposit metal ions dissolved in the electrolyte onto one of the electrodes. As a consequence, the deposited metal ions may form a layer or a structure of solid metal.

Figure 1B:
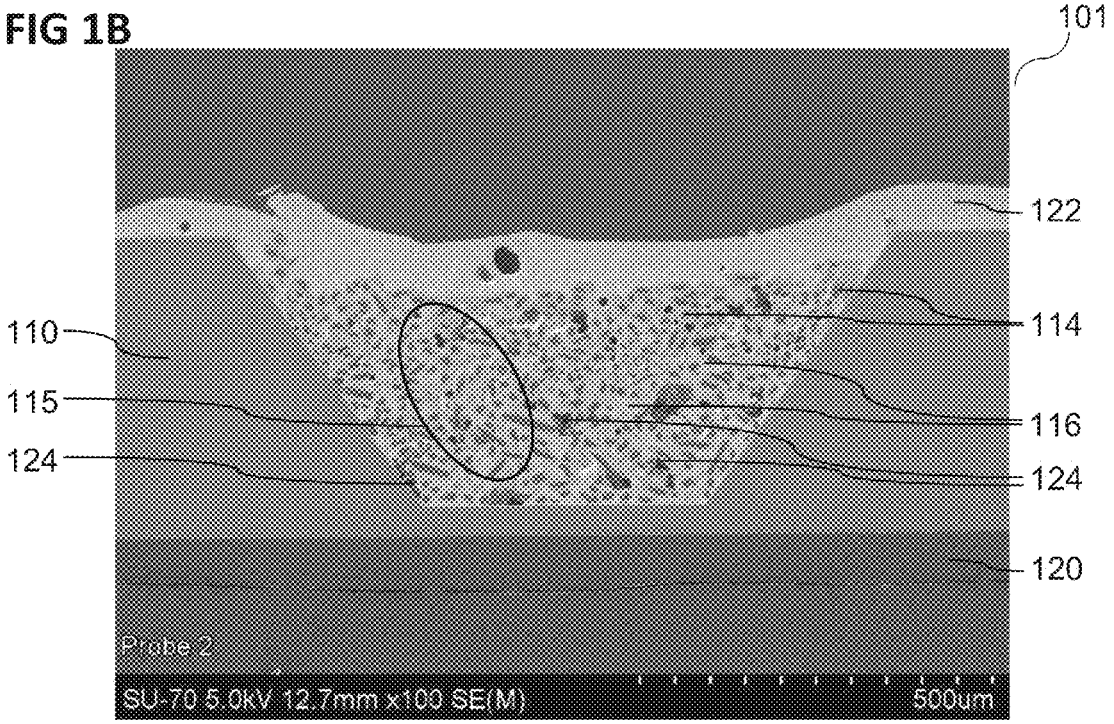
Figure 1C:
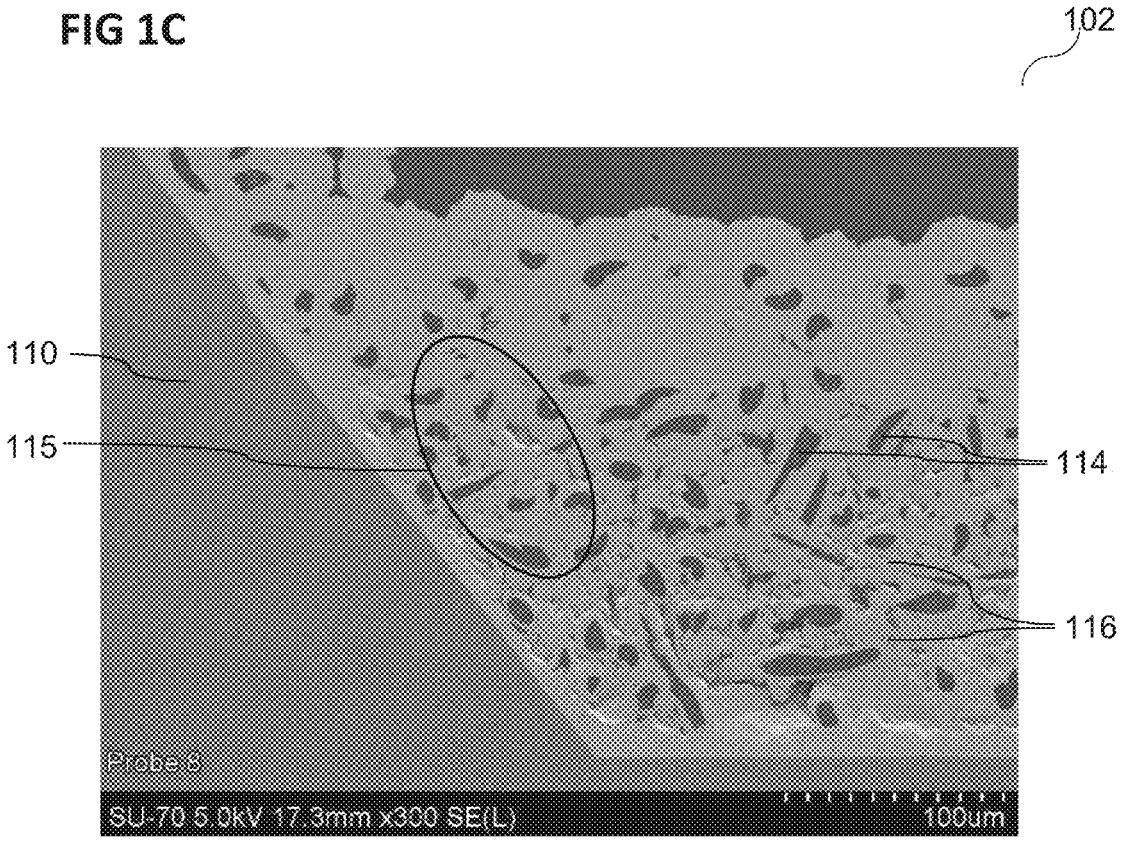

FIG. 1A to FIG. 1C show contour plots 100, 101 and 102 of polished cut images of carbon-copper composite materials 115.

The composite material 115 shown in FIG. 1A may have been formed by filling particles 114 of a first component of the composite material 115, for example carbon fibers 114 or carbon fibers 114 coated with a metal layer, into a cavity 112 formed in a carrier 110. This may also be referred to as a stack of particles 114, e.g. of the first component, e.g. stack of fibers 114, e.g. stack of carbon fibers 114. In order to describe individual features of some of the particles (e.g. carbon fibers) 114, they are labelled with 114*a* to 114*c*. A second component 116 of the composite material, for example copper, also has several regions labelled with indexed numbers 116*a* to 116*c* for easy reference to the individual regions.

After filling the cavity 112 up to a desired thickness of the composite material 115, e.g. several 100 μm, with the particles (e.g. carbon fibers) 114, an electrolyte 118 may be arranged at least in the cavity 112.

A power supply (not shown) may be provided. One of the terminals (not shown) of the power supply may be electrically connected to the carrier 110, thereby forming a first electrode, for example a cathode if the negative terminal of the power supply is used. Another terminal of the power supply may be electrically connected to another electrode (not shown), for example an anode if the positive terminal of the power supply is used, that may be arranged in physical and electrical contact with the electrolyte 118. A voltage, for example a DC voltage, applied to the electrodes may cause a current through the electrolyte and may cause metal ions of the electrolyte, for example copper ions, to accumulate on one of the electrodes. In case of the copper ions, they may accumulate on the cathode, in this case on the carrier 110 and on the particles (e.g. carbon fibers) 114 arranged in the cavity 112 of the carrier 110. The particles (e.g. carbon fibers) 114 may be physically and electrically connected to the carrier 110 and thus represent part of the electrode. The metal ions deposited out of the electrolyte 118 may be replenished by metal ions transferred from the other electrode (e.g. the anode) into the electrolyte. By way of example, the other electrode may be a copper electrode, and the electrolyte may be copper sulfate. In other words, an electrodeposition of the second component 116 of the composite material between and/or around the particles of the first component 114 of the composite material and on the carrier 110 may be performed.

The electrodeposition of the second component 116 of the composite material may be diffusion limited: In regions of the electrolyte 118 where deposited metal ions are quickly and/or easily replenished by metal ions from the other electrode, for example regions with a close proximity to the other electrode, e.g. regions on or near a top of the stack of particles 114 of the first component, a metal layer may be formed thickly and/or fast. In other regions of the electrolyte 118, where deposited metal ions are replenished only slowly or not at all, for example regions that are far away from the other electrode, e.g. regions on or near a bottom of the stack of particles 114 of the first component, only a thin metal layer or essentially none may be formed. For example, electrolyte-filled cavities 124 (see FIG. 1B) may remain where no second component 116 of the composite material may have formed between the particles of the first component 114, even after a closed layer of composite material may have formed on top of the particles of the first component 114. As a consequence, a diffusion limited formation of the composite material with the desired thickness of e.g. several 100 μm may lead to a porous composite material 115 with degraded performance, e.g. with respect to electrical and/or thermal conductivity and/or heat capacity.

Examples of diffusion limited formation of the composite material 115 may be found in FIG. 1A and FIG. 1B. In FIG. 1A, around the particle (e.g. carbon fiber) 114*a* at the top of the stack of particles (e.g. fibers) 114 that may partially fill the cavity 112, near the other electrode that is not shown but may be located near the top of the figure, a relatively thick coating 116*a* of the second component 116 of the composite material may have formed. In the middle of the stack, around particle (e.g. fiber) 114*b*, the coating 116*b* may be thinner, and thinner yet may be the coating of the second component 116*c* further down in the stack of particles (e.g. fibers) 114, for example around the particle (e.g. fiber) 114*c*.

For forming the composite materials shown in FIG. 1A, FIG. 1B and FIG. 1C, so-called pulse plating may have been used. While in a typical electroplating process, DC voltage may be supplied to the electrolyte 118 as continuous DC voltage, in pulse plating, the DC voltage may be supplied intermittently, in other words, as voltage pulses. Times where the voltage is supplied may be referred to as ON times, and times where the voltage is not supplied to the electrolyte 118 may be referred to as OFF times. For forming the composite materials of FIG. 1A and FIG. 1B, a ratio of durations of ON times to OFF times may have been approximately 1/3. The forming of the composite material in FIG. 1A may have taken approximately 30 minutes. Pulse plating may provide time for diffusion of the metal ions during the OFF times.

FIG. 1B shows the composite material that may be formed if the pulse plating (with the parameters described above) is continued until spaces between the particles (e.g. fibers) 114 are filled as well as possible by the electroplated second component 116 of the composite material 115, and further filling the cavity with tin-solder 122. A number of cavities 124 not filled with the second component 116 of the composite material may remain, such that a porous copper-carbon composite material 115 may be formed.

A formation of the cavities 124 may be avoided if parameters of the pulse plating are adjusted to have a much lower ratio of ON times and OFF times, e.g. ON time/OFF time=1/50 or 1/100. An example of a copper-carbon composite material formed using such a ratio of approximately 1/50 is shown in FIG. 1C. Here, the spaces between the particles 114 of the first component of the composite material, e.g. the carbon fibers, may be almost completely filled by means of the electroplating with the second component 116 of the composite material 115, e.g. the copper. However, the long OFF times (in relation to the ON times), during which no forming of the second component 116 takes place, lead to an extremely long total processing time, which would make such a process for forming thick composite material layers economically unattractive. For example, the processing time for forming the composite material of FIG. 1C was approximately 60 hours.

The composite material 115 on the carrier 110 in FIG. 1A to FIG. 1C may be considered as forming a structure of the composite material 115, for example it may form part of a conductive line formed on/in the carrier 110. Forming such a structure may require that structures (e.g. the cavities 112) are formed first and then filled homogeneously with the particles (e.g. fibers) 114. When the electrolyte 118 is filled in, care may need to be taken (e.g., a dedicated device holding the particles (e.g. fibers) in place may have to be provided) to ensure that the particles (e.g. fibers) are not washed out of the structures by the electrolyte and the impulse it carries when it is filled in. An automization of such a process may be difficult.

In various embodiments, a method for forming a composite material is provided that may alleviate or avoid the above mentioned problems.

In various embodiments, a method is provided that may allow for forming a composite material essentially without cavities between particles of a first component of a composite material and/or within a second component of the composite material and/or between the particles of the first component of the composite material and the second component of the composite material, and that may allow forming the composite material within shorter processing times than conventional methods.

In various embodiments, a layer and/or a structure of particles of a first component of a composite material may form on and/or in a carrier after an electrolyte was brought into contact with the carrier. Hence it may be possible to avoid a destruction of the layer and/or the structure formed by the particles of the first component of the composite material when the electrolyte is brought into contact with the carrier, and to avoid a provision of a dedicated means to prevent the destruction.

In various embodiments, particles of a first component of a composite material may be homogeneously distributed in an electrolyte (the homogeneity of the distribution may refer to a homogeneous spatial distribution of the particles of the first component of the composite material in the electrolyte), and a thin layer of the particles may be formed by means of the particles sedimenting out of the electrolyte, thereby settling on a carrier. A second component of the composite material may be formed between the particles and between the particles and the carrier by means of electroplating. The layer of the particles may be thin enough to avoid the electroplating from being diffusion limited. A desired thickness of the composite material may be achieved by repeating the processes of sedimentation of the particles and electroplating.

In various embodiments, the particles may be fibers, e.g. carbon fibers. The layer of particles, which may be much thinner than the cavity filled with carbon fibers described in context with FIG. 1A to FIG. 1C, may allow for a better alignment of the length of the carbon fibers with an xy-direction (see FIG. 7) of the layer of particles. Since the CTE of carbon fibers may have a strong dependence on their geometry (being low along their length and high along their thickness), this may allow for reaching a lower CTE in the composite material than with more randomly oriented carbon fibers in a larger volume.

Figure 2A:
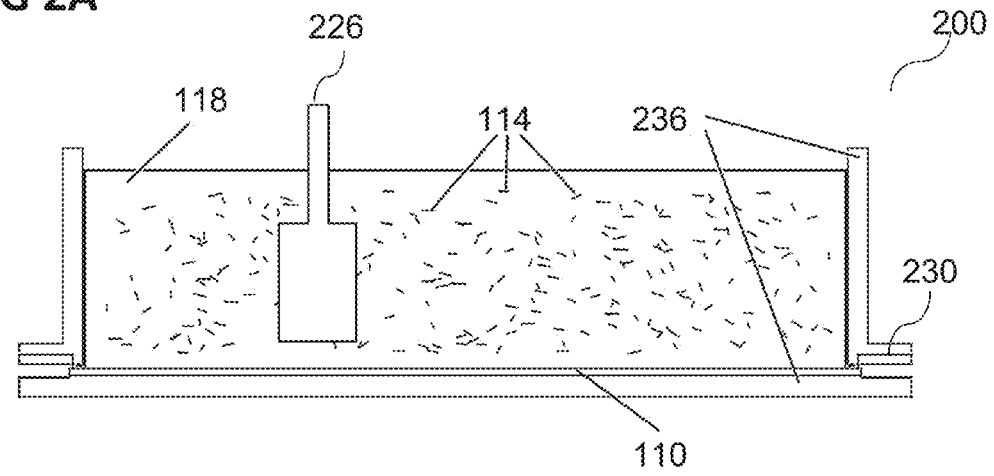
FIG. 2A and FIG. 2B show two stages of a method of forming a composite material in accordance with various embodiments.
Figure 2B:
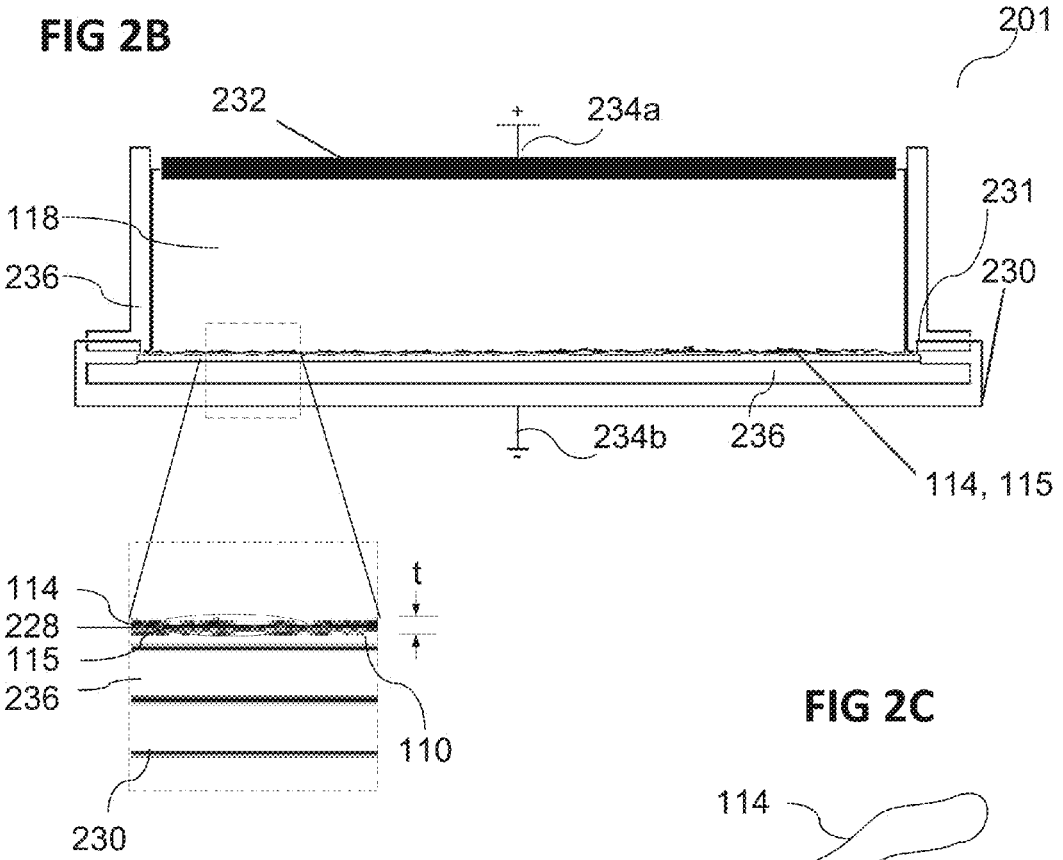

FIG. 2A and FIG. 2B show two stages 200, 201 of a method of forming a composite material 115 in accordance with various embodiments.

As shown in FIG. 2A, a suspension including a plurality of particles 114 of a first component of the composite material 115 and an electrolyte 118 may be provided. The suspension 118, 114 may be arranged in physical contact with a carrier 110. The particles 114 of the first component of the composite material 115 (which may also simply be referred to as "the particles"; furthermore, the reference number 114 may be used for both, the particles of the first component and the first component itself) may sediment on the carrier 110, thereby forming a layer of sedimented particles 114. Between the sedimented particles 114, i.e. in the layer of sedimented particles 114, a plurality of spaces 228 (more clearly shown in FIG. 3A) filled with electrolyte 118 may be formed. An electroplating process may be carried out. Thereby, a second component 116 (see e.g. FIG. 3A or FIG. 3B) of the composite material 115 may be formed from the electrolyte 118 in at least a fraction of the plurality of spaces 228. Thus, the composite material 115 including the first component 114 and the second component 116 may be formed, for example a layer of the composite material 115.

In various embodiments, the carrier 110 may be any kind of carrier 110 on which a composite material 115 is to be formed. The carrier 110 may for example be made of or include a semiconductor, for example a wafer, e.g. a silicon wafer. Alternatively, the carrier 110 may be or include an electrically conductive material, for example copper, aluminum and the like, or the carrier 110 may made of or include or may be made of a dielectric material, for example glass or ceramics. The carrier 110 may include an electrically conductive layer, for example a metal layer, in particular if a base material of the carrier 110 is not electrically conductive. The electrically conductive layer may for example include a metal, e.g. at least one of copper, silver, and chromium. The conductive layer may also be referred to as the seed layer. In various embodiments, the carrier 110 may be a printed circuit board.

In various embodiments, the particles 114 may for example have a low coefficient of thermal expansion (CTE), at least along one of their dimensions. The particles 114 may for example include carbon, or the particles 114 may essentially consist of carbon. The particles 114 may for example be carbon fibers 114. The carbon fibers may for example include graphite. See FIG. 7 and the corresponding description for details about how carbon fiber particles 114 may influence the CTE of the composite material 115. The particles 114 may for example be carbon nanotubes. The particles 114 may for example include or essentially consist of diamond, graphite, or amorphous carbon. The particles 114 may include or essentially consist of other electrically and/or thermally conductive materials, for example a metal and/or a metal alloy, for example one or more of nickel, chromium, iron, platinum, tungsten, palladium, manganese, platinum-iridium, iron-nickel (e.g. invar) and the like or a non-metallic material like boron nitride (which may have a low or even negative CTE in at least one plane of its crystal lattice) or aluminum nitride.

Figure 8:
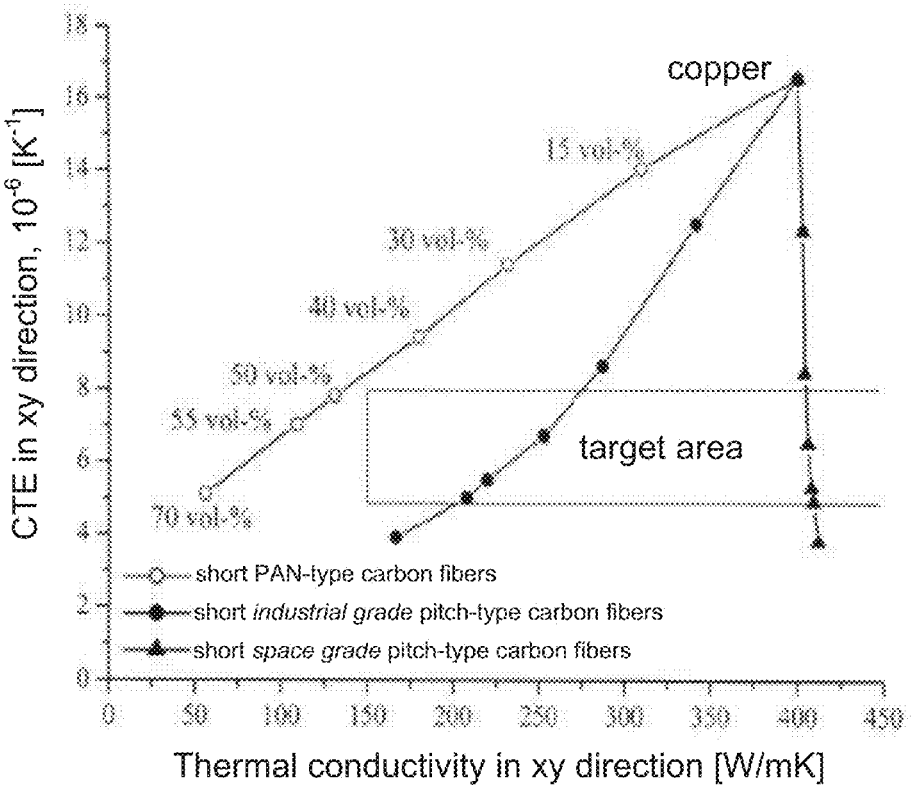
FIG. 8 shows a variation of a coefficient of thermal expansion of a carbon-copper composite material as a function of thermal conductivity.
Figure 8:
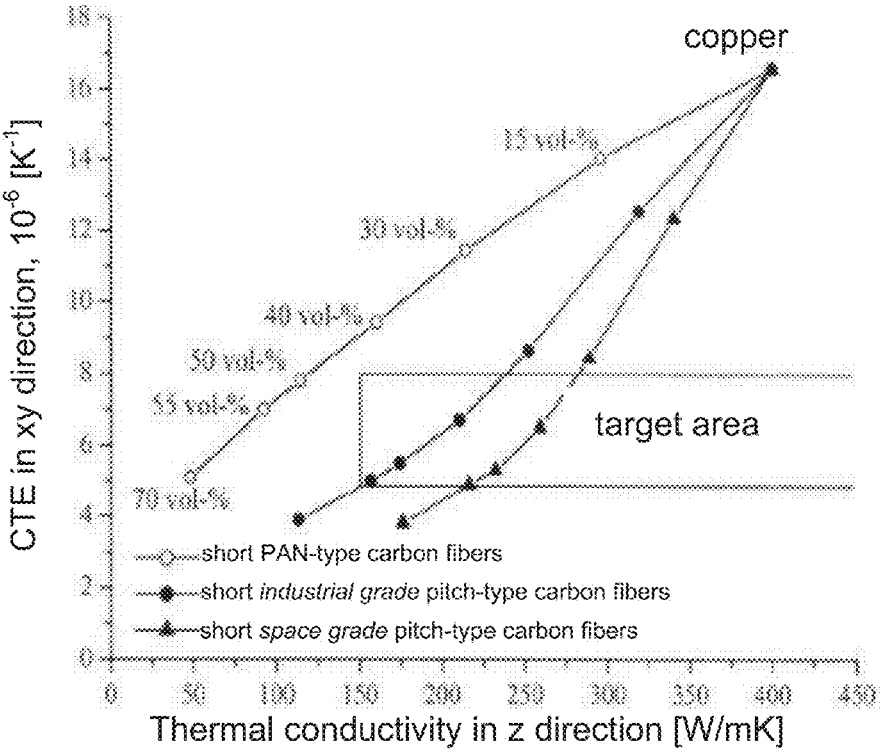
Figure 9:
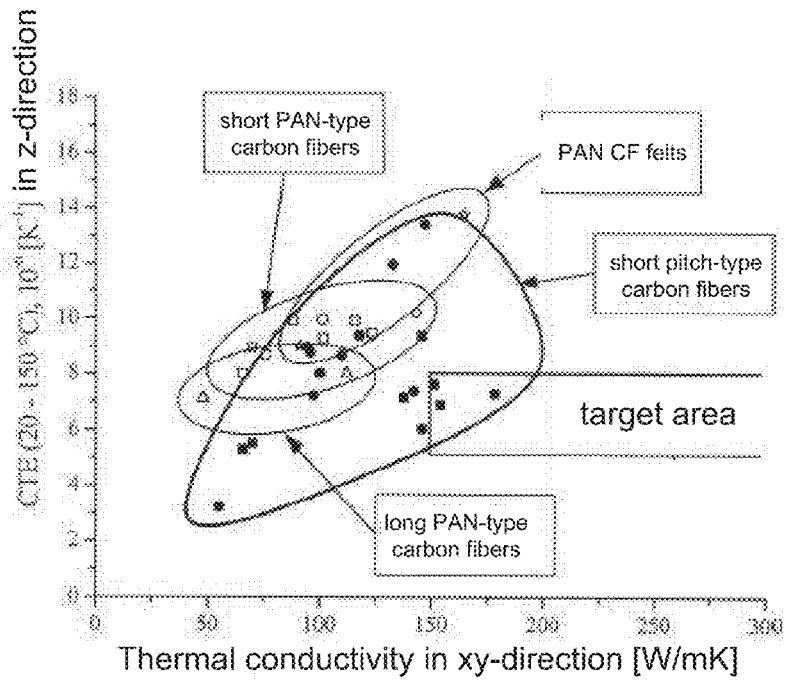
FIG. 9 shows graphs visualizing parameter pairs of thermal conductivity and CTE for various copper composite materials.
Figure 9:
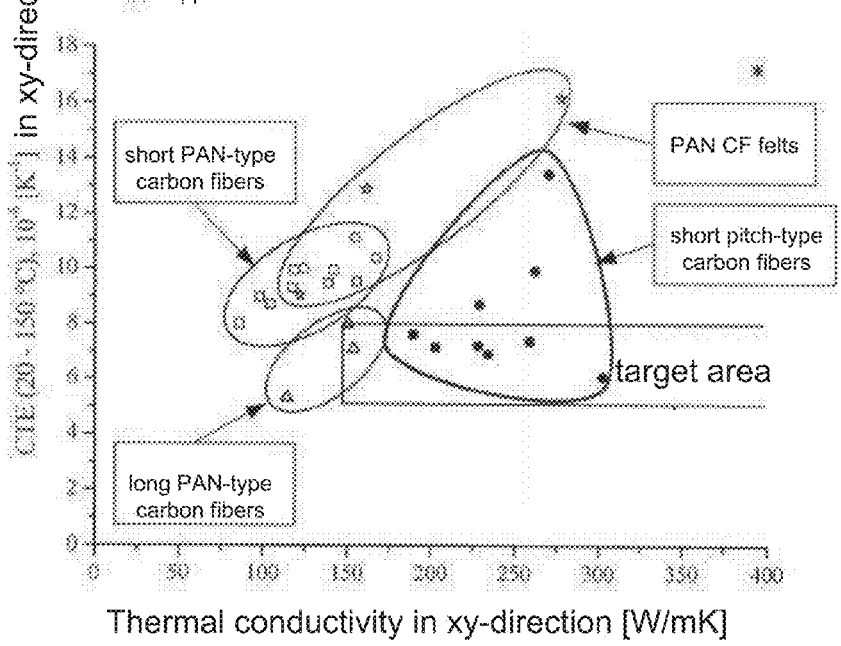

Depending on a desired property (e.g. high electrical and/or thermal conductivity), the material of the particles 114 of the first component of the composite material 115 may be chosen such that the desired property of the material of the particles 114 of the first component of the composite material 115 (a primary parameter) is degraded at most by a tolerable amount compared to that of the second component 116 of the composite material 115 (which it may be considered to replace, since the composite material 115 may be used instead of a structure formed only from the second component 116 of the composite material 115). An example for the degradation regarding the primary parameter that may be tolerated for the benefit of approximating the CTE of the carrier 110 is shown in FIG. 9. Here, parameter pairs of CTE and thermal conductivity are shown in two graphs 900, 901 for various composite materials (x, y and z direction may be defined as shown in FIG. 8). A region labelled "target area" may indicate a desired parameter range regarding CTE and thermal conductivity.

In various embodiments, the particles 114 of the first component of the composite material 115 may have a diameter in a range from about 1 μm to about 15 μm, for example from about 3 μm to about 8 μm, for example around 5 μm. In other embodiments, the particles 114 may be smaller or larger than the specified range. In various embodiments in which the particles 114 of the first component of the composite material 115 may include fibers, for example carbon fibers, the fibers 114 may have a diameter in a range from about 1 μm to about 15 μm, for example from about 3 μm to about 8 μm, for example around 5 μm and a length in a range from about 10 μm to about 100 μm, for example from about 20 μm to about 50 μm, for example around 30 μm. In other embodiments, the fibers 114 may be thinner or thicker, longer or shorter than the specified ranges. In various embodiments in which the particles 114 of the first component of the composite material 115 may include carbon nanotubes, the carbon nanotubes 114 may have a diameter in a range from about 1 nm to about 10 nm, for example from about 1 nm to about 2 nm, and a length that may be several thousand to several million times the diameter, for example a length in a range from about 1 μm to about 3 mm, for example from about 20 μm to about 50 μm, for example around 30 μm. In other embodiments, the carbon nanotubes 114 may be thinner or thicker, longer or shorter than the specified ranges.

Figure 2C:
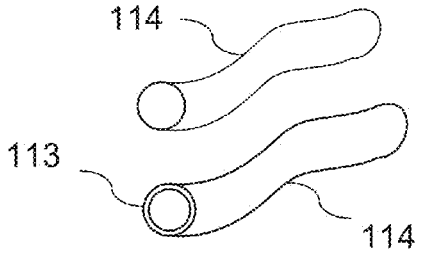
FIG. 2C shows fibers that may be used in various embodiments.

In various embodiments, the particles 114 of the first component of the composite material, for example the carbon fibers, may be uncoated, as shown in FIG. 2C at the top. In various other embodiments, the particles 114 of the first component of the composite material, for example the carbon fibers, may be coated with a coating 113 as shown in the bottom of FIG. 2C. The coating may in particular be applied in a case where a material of a bulk of the particles 114 is not electrically conductive. The particles 114 may for example be coated with a metal or metal alloy. In other words, metal or metal alloy, e.g. a metal layer 113, may at least partially (e.g. fully) coat the particles 114 of the first component of the composite material 115. The coating 113 may include or consist of at least one of copper, nickel, chromium, palladium and manganese. The coating 113 may have a thickness that is much smaller than the diameter of the particle 114, for example the fiber 114, for example the carbon fiber 114. The thickness of the coating 113 may be in a range from about 1% to about 25% of the diameter of the particle 114, for example in a range from about 5% to about 15%.

In various embodiments, more than one type of particles 114 may be used during a forming of a single layer of sedimented particles 114 and during the forming of the composite material 115. The different types of particles 114 may have different sedimentation velocities but comparable sizes, or the faster sedimenting particles may be smaller. This may essentially lead to a separation of the different particles 114 in the sedimented layer of particles 114, with the particles with the higher sedimentation velocity being arranged closer to the carrier 110.

Alternatively, the different types of particles 114 may have essentially comparable sedimentation velocities. In that case, the different types of particles 114 may sediment out of the electrolyte 118 essentially at the same time, thereby forming a layer of sedimented particles 114 that may be a mixture, e.g. a homogeneous mixture, of particles 114 of the different types of particles 114. Such an essentially homogeneous mixture of sedimented particles 114 in the layer of sedimented particles 114 may also be obtained if the slower sedimenting particles 114 are smaller, for example much smaller than the faster sedimenting particles 114. In that case, the faster sedimenting particles 114 may sediment out of the electrolyte 118, thereby forming a layer of sedimented particles 114 including primarily the larger, faster sedimenting particles 114. The layer of sedimented particles 114 may include spaces 228 between the sedimented particles 114. At least partially into those spaces 228 may the slower sedimenting particles 114 then sediment, thereby forming a layer of sedimented particles 114 that may be a mixture, e.g. a homogeneous mixture, of particles 114 of the different types of particles 114.

In various embodiments, the suspension 118, 114 may be arranged in a container 236. The carrier 110 may also be arranged in the container 236. The carrier 110 may for example be arranged on a bottom of the container 236, and a side of the carrier 110 on which the composite material 115 is to be formed may be facing upward, i.e. away from the bottom of the container 236. When the electrolyte 118 or the suspension 118, 114 is arranged in the container 236, the electrolyte 118 or the suspension 118, 114 may completely or partly cover the carrier 110, e.g. the side of the carrier 110 facing away from the bottom of the container 236.

In various embodiments, the electrolyte 118 may first be arranged in the container 236 (e.g. filled into the container 236), and the particles 114 of the first component of the composite material 115 may then be added to the electrolyte 118 to form the suspension 114, 118. Alternatively, the particles 114 may first be arranged in the container 236 (e.g. filled into the container 236), and the electrolyte 118 may then be added to the particles 114 to form the suspension 114, 118.

In various embodiments, after the electrolyte 118 and the particles 114 are mixed to form the suspension 114, 118, the suspension 114, 118 may be treated, e.g. moved, in such a way that the particles 114 are essentially homogeneously distributed in the electrolyte 118. The distribution of the particles 114 of the first component of the composite material 115 in the electrolyte may be considered as being homogeneous if the distance of each of the particles 114 to its nearest neighbor is essentially independent of a position of the particle 114 in the electrolyte 118. The particles 114 may be distributed over the whole volume of the electrolyte 118. This means that in the homogeneous state of the distribution of the particles 114, at least a fraction of the particles may be floating in the electrolyte 118.

By way of example, for obtaining the essentially homogeneous distribution, the container 236 with the suspension 114, 118 may be moved. Alternatively, the container 236 may remain stationary, while only the suspension 114, 118 may be moved (e.g. stirred), or a moving of the container 236 and of the suspension 114, 118 itself may be combined. In various embodiments, a homogenizer 226 may be used for the homogenizing of the distribution of the particles 114 in the electrolyte 118. The homogenizer 226 may for example include a shaker that causes the container 236 or/and a dispenser (not shown) in which the suspension may be arranged and homogenized before being arranged on the carrier 110 (in the container 236) to vibrate, shake, tilt, rotate or to perform any other movement that may be suitable for arriving at a homogeneous distribution of particles 114 in the electrolyte 118. Stirring by hand in a dispenser and pouring the suspension 114, 118 into the container 236 may reach a sufficiently homogeneous distribution of the particles 114 in the electrolyte 118. In various embodiments, however, an automization of the homogenizing may be desired. The homogenizer 226 may be configured as a stirring device 226 (in FIG. 2A, the homogenizer 226 is, as an example, formed as a muddler 226) that is suitable for setting and/or keeping the suspension 114, 118 in motion in such a way that a homogeneous distribution of particles 114 in the electrolyte 118 may be achieved while the container 236 and/or the dispenser may remain stationary. In various embodiments, a part of the homogenizer 226, e.g. of the stirring device 226, may be moved through the electrolyte 118. In that case, the part may be moved in an essentially random fashion, such that the suspension 114, 118 may not be given a preferential direction. The stirring device may for example include one or more propellers, jets, muddlers or the like. In various embodiments, a bulk motion (e.g. a rotation or a laminar flow) of the suspension 114, 118 that may direct the particles in a preferred direction may be prevented. A stirring device having a plurality of propellers, jets, muddlers or the like may reach a homogeneous distribution more easily than a stirring device having a single propeller, jet, muddler, or the like, for example by means of creating a turbulent flow, rather than a laminar flow. A turbulent flow may for example be created by propellers rotating in opposite directions, or by jets directed at each other. The stirring device may be arranged at the container 236 or at the dispenser in such a way that it can homogenize the suspension 114, 118 in the container 236 or/and in the dispenser, respectively.

The stirring device may be arranged to homogenize the suspension 114, 118 in the container 236 and/or in the dispenser. If the suspension 114, 118 is formed (and possibly homogenized) in the dispenser, the suspension 114, 118 may thereafter be arranged on the carrier 110 (in the container 236) as the suspension 114, 118 with the homogeneously distributed particles 114, or the suspension 114, 118 may be (e.g. further or for the first time) homogenized in the container 236.

In various embodiments, an amount of particles 114 of the first component of the composite material 115 that may be essentially homogeneously distributed in the electrolyte 118 may be approximately the amount that is necessary for forming a layer of particles 114 of the first component of the composite material 115 of a thickness that is desired for the layer to be formed next (which may be different from the desired total thickness of the composite material 115). In other words, essentially all particles 114 that may be homogeneously distributed in the electrolyte 118 may be used for forming one layer of particles 114 and, by means of the following electroplating, for forming one layer of the composite material 115.

In various embodiments, at least a part of the homogenizer 226 may be removed from the suspension 114, 118 after the homogeneous distribution of the particles 114 is achieved.

After the arranging of the suspension 114, 118 containing the particles 114 in an essentially homogeneous distribution in the electrolyte 118 in physical contact with the carrier 110, e.g. on the carrier 110, below the carrier 110 or side-by-side with the carrier 110, in various embodiments, the particles 114 of the first component of the composite material 115 may be enabled to sediment (also referred to as settling) out of the suspension 114, 118. For example, the homogenizer 226 may be stopped, such that the suspension 114, 118 may come to rest and the particles 114 may be free to move in the electrolyte 118 following remaining forces acting on them. During sedimentation, a bulk motion (for example a rotation or a streaming) of the suspension 114, 118 may be prevented, in order to prevent the sedimentation of particles preferentially in specific places. For example, a rotation of the suspension 114, 118 during the sedimentation may lead to a layer of sedimented particles 114 which has more particles 114 sedimented near an outer perimeter of the suspension 114, 118 than near the center of the suspension 114, 118. A turbulent, random motion of the suspension 114, 118 may however be present in various embodiments at least during an initial phase of the sedimentation. Nevertheless, a homogeneous distribution of the particles 114 in the sedimented layer may be obtained.

In various embodiments, the force acting on the particles 114 and causing them to sediment out of the suspension 114, 118 may be gravity. Thus the particles 114 may follow gravity and sink to the bottom of the container 236. This may be the case if the particles 114 have a higher density than the electrolyte 118. At the bottom of the container 236 (and at the bottom of the electrolyte 118 and in physical contact with the electrolyte 118), the carrier 110 may be arranged with the side on which the composite material 115 is to be formed facing upwards, i.e. towards the suspension 114, 118. The carrier 110 may be arranged essentially horizontally. Consequently, the particles 114 may form a layer of sedimented particles 114 on the side of the carrier 110 on which the composite material 115 is to be formed.

In various embodiments, the force acting on the particles 114 and causing them to sediment out of the suspension 114, 118 may be buoyancy. Thus the particles 114 may follow buoyancy and float to a top of the electrolyte 118. At the top of the electrolyte 118 and in physical contact with the electrolyte, the carrier 110 may be arranged with the side on which the composite material 115 is to be formed facing downwards, i.e. towards the suspension 114, 118. The carrier 110 may be arranged essentially horizontally. Consequently, the particles 114 may form a layer of sedimented particles 114 on the side of the carrier 110 on which the composite material 115 is to be formed.

In various embodiments, the force acting on the particles 114 and causing them to sediment out of the suspension 114, 118 may be centrifugal force. Thus the particles 114 may follow the centrifugal force and be moved to an outer perimeter of the electrolyte 118. At the outer perimeter of the electrolyte 118 and in physical contact with the electrolyte, the carrier 110 may be arranged with the side on which the composite material 115 is to be formed facing towards a center of the container 236, i.e. towards the suspension 114, 118. The carrier 110 may be arranged essentially vertically. Consequently, the particles 114 may form a layer of sedimented particles 114 on the side of the carrier 110 on which the composite material 115 is to be formed.

In various embodiments, the sedimentation of the particles 114 of the first component of the composite material 115 may be accelerated or delayed by means of surface active agents that may for example promote wetting, like alcohols or tensides.

In various embodiments, the sedimented particles 114 may form a layer of particles 114. In other words, a distribution of the particles 114 may be formed from the essentially homogeneous distribution of the particles 114 that may be inhomogeneous with respect to a direction in which the force acts that causes sedimentation (i.e., in a vertical direction in case of gravity and buoyancy, in a radial direction in case of centrifugal force), with the particles 114 accumulating in a part of a volume of the suspension 114, 118 where they meet a barrier when following the force acting on them and leaving the rest of the volume of the suspension 114, 118 essentially void of particles, but the distribution of the particles 114 may be homogeneous in a direction essentially vertical to the direction in which the force acts that causes the sedimentation. In other words, within the layer, the particles 114 may be homogeneously distributed. In various embodiments, larger particles 114, due to the ratio of volume and surface, may sediment first (e.g. in the case of following gravity, the larger particles may sink to the bottom first). Smaller particles 114 sedimenting later may arrange themselves between the sedimented larger particles 114.

In various embodiments, applying ultrasound and/or other kinds of vibrations to the suspension 114, 118, the carrier 110 and/or the container 236 may lead to a more compact and/or more homogeneous distribution of the particles 114.

In various embodiments, essentially each of the particles 114 may be directly or indirectly in physical contact with the carrier 110. In other words, the particles 114 of the layer of particles 114 that are closest to the carrier 110 may rest against the carrier 110, i.e. they may be in direct physical contact with the carrier 110. Particles further away from the carrier 110 may either still be in direct contact with the carrier 110, for example if they are tilted with respect to the carrier 110, and/or they may be in physical contact with other particles 114 that are in direct physical contact with the carrier 110.

In various embodiments, a thickness of the layer of particles 114 may be in a range from about 1 μm to about 50 μm, for example in a range from about 5 μm to 30 μm, for example from about 10 μm to about 20 μm. The layer thickness may depend on the thickness of the particles 114, for example the thickness of the layer may be a multiple (e.g. small multiple) of the thickness of the particles 114, e.g. less than or equal to ten times the thickness of the carbon fibers. By way of example, for carbon fibers with a thickness (e.g. diameter) of about 5 μm, the layer may have a thickness of about 30 μm, which would correspond to six times the thickness of the carbon fibers 114. The layer of particles 114 may be thin enough to avoid a diffusion limitation of the electroplating.

During and/or after the sedimentation, in various embodiments, a plurality of spaces 228 may be formed between the particles 114. The spaces 228 may be filled with electrolyte 118. The layer of particles 114 of the first component of the composite material 115 may be thin enough for essentially all spaces 228 to be in fluid communication with the electrolyte 118 outside the spaces 228. In various embodiments, this may be the case before the electroplating of the sedimented layer of particles 114, and also during and even after the electroplating.

During and/or after the sedimentation, in various embodiments, a second component 116 of the composite material, for example a metal layer 116 may be electroplated (in other words, deposited by means of electroplating or, in still other words, electrolytically deposited, also referred to as galvanic or electrolytic deposition) over at least a fraction of the particles 114 of the first component of the composite material 115 and over the carrier 110. In other words, at least a fraction of the particles 114 of the first component of the composite material 115 may be coated with the second component 116 of the composite material, e.g. with a metal. In yet other words, by means of the electroplating process, the second component 116 of the composite material 115 may be formed from the electrolyte 118 in at least a fraction of the plurality of spaces 228.

In various embodiments, the electrodeposition may be carried out long enough and with a high enough deposition rate that the layers of the second component 116 of the composite material 115 of adjacent particles 114 join, thereby essentially filling the spaces 228. In other words, an essentially solid, essentially non-porous composite material 115 containing the first component 114 and the second component 116 may be formed. This may for example provide good electrical conductivity, and/or good thermal conductivity.

Alternatively, the electroplating may be aborted before all the spaces 228 are filled, for example if a porous structure of the composite material 115 is desired. In the porous structure of the composite material 115, the remaining spaces 228 may still be in fluid communication with the electrolyte 118. After the forming of the composite material 115 and a removal of the electrolyte 118, the porosity of the composite material 115 may be used for filling with a third material, for example with solder. In various embodiments, other parameters may be varied, for example the size and/or composition of the particles 114. An example of this is shown in FIG. 3B, which will be described in more detail further below.

In various embodiments, the electroplating process may be carried out after essentially all particles 114 have sedimented out of the electrolyte 118. In other embodiments, the electroplating process may be carried out while at least some of the particles 114 are still sedimenting. In other words, the electroplating may be started after only a part of the layer of particles 114 has formed. In that case, the electroplating may continue until essentially all particles 114 in the suspension 114, 118 have settled in the layer, or the electroplating may be aborted before all the particles 114 have settled.

In various embodiments, the electrolyte 118 may be a metal electrolyte, for example a metal salt, for example a copper-, zinc-, gold-, silver-, nickel-electrolyte, or any other suitable metal electrolyte. The electrolyte may for example include at least one of copper(II) sulfate ($CuSO_4$), nickel (II) sulfate ($NiSO_4$), silver nitrate ($AgNO_3$), silver cyanide (AgCN), gold potassium cyanide ($K[Au(CN)_2]$) and the like.

In various embodiments, a power source 234*a*, 234*b* may be provided that is configured to supply a voltage to a first electrode 232 and to a second electrode. The first electrode 232 may be an anode, and the second electrode may be a cathode. The first electrode 232 and the second electrode may be arranged to physically contact the electrolyte 118. The first electrode 232 may for example be arranged to dip into the electrolyte 118 (for example in a case where the carrier 110 may be arranged on the bottom or on the side of the container 236) or to be arranged at the bottom of the container 236 (for example in a case where the carrier 110 may be arranged at the top of the electrolyte). The first electrode 232 may include metal. The second electrode may include the carrier 110. Besides the carrier 110, the second electrode may include the particles 114 that are in physical and electrical contact with the carrier 110. For example, all electrically conductive particles 114 of the first component of the composite material 115 that are in direct or indirect physical contact with the carrier 110 may form part of the cathode. In case of dielectric particles 114, the particles 114 may be coated with an electrically conductive coating 113, such that they may form part of the cathode when they are in direct or indirect physical contact with the carrier 110. The carrier 110 may for example be electrically contacted by means of a needle contact 231. In a case where a bulk material of the carrier 110 is not electrically conductive, the carrier 110 may be electrically contacted at the seed layer.

In various embodiments, the power source 234*a*, 234*b* may provide a DC voltage. The first electrode 232 may be configured to receive a positive voltage and may thus be considered to be an anode 232. The carrier 110 may receive a negative voltage (a negative potential with respect to the electrolyte 118 and with respect to the first electrode 232) and may thus be considered to be a cathode. When the power is switched on and the positive voltage and the negative voltage are supplied to the anode 232 and the cathode, respectively, a current may flow through the electrolyte 118 by means of moving ions. Metal ions of the electrolyte 118 may flow towards the cathode and may be deposited there to form the metal layer. The deposited ions may be replenished to the electrolyte 118 from the anode 232. The anode 232 may include a metal that matches the electrolyte, i.e. the anode 232 may include the same metallic element as the electrolyte includes in the form of a metal salt. In various embodiments, the anode 232 may include copper, and the electrolyte 118 may include a copper salt, e.g. copper(II) sulfate ($CuSO_4$). In other embodiments, the anode may for example include silver, nickel, gold and the like, with the respective matching electrolyte, for example as listed above.

In various embodiments, the first electrode 232 may be configured and arranged in such a way that its distance to the layer of particles 114 is essentially the same for any region of the layer of particles 114.

In various embodiments, a voltage difference between the electrodes may be in a range from about 2 V to about 10 V, for example between 3 V and 8 V, for example between 4 V and 6 V.

In various embodiments, the voltage difference may be kept constant over time (or a constant current may be maintained). This may cause a continuous formation of the second component 116 of the composite material 115.

In various other embodiments, the voltage difference may be supplied as voltage pulses. This may cause a pulsed, in other words discontinuous, formation of the second component 116 of the composite material 115, because the second component 116 of the composite material 115 may only be formed during the ON times. The voltage pulses may have a frequency in a range from about 1 Hz to about 1 kHz. The ratio of ON times to OFF times may be 1 or smaller, for example the ratio of ON time to OFF time may be 1/3 to 1/10.

The lack of diffusion limitation during the formation of the thin layer of the composite material 115 may make it possible to use high currents, which may lead to high deposition rates. For example approximately 1 μm of sedimented particles 114 per minute may have the spaces 228 between them filled with the second material 116 of the composite material 115, in accordance with various embodiments.

As a consequence of the formation of the composite material not being diffusion limited, in various embodiments, the (thick) composite material 115 formed from several (thin) layers of composite material may be formed much faster than described above in context with FIG. 1C for the pulsed electroplating with long OFF times. Whereas in the above example the formation of the composite material 115 with a thickness of approximately 200 μm required about 60 hours of pulsed electroplating, the electroplating of a layer with a thickness of about 10 μm (which may be thin enough such that the formation of the second component 116 of the composite material 115 is not diffusion limited) may be accomplished in a few, for example around 10, minutes. Building up a structure of composite material 115 with a thickness of about 200 μm may thus require approximately 200 minutes, which is much less than the 60 hours that would be required if the diffusion limited formation of the second component 116 had to be avoided by means of a high ratio of OFF times to ON times.

In various embodiments, the carrier 110 may be automatically processed for forming the composite material 115 thereon.

The composite material 115 formed on the carrier 110, for example directly on the carrier 110, for example may have a CTE that is closer to the CTE of the carrier 110, for example of the semiconductor material of the carrier 110, than the CTE of the second component 116 of the composite material 115.

Figure 3A:
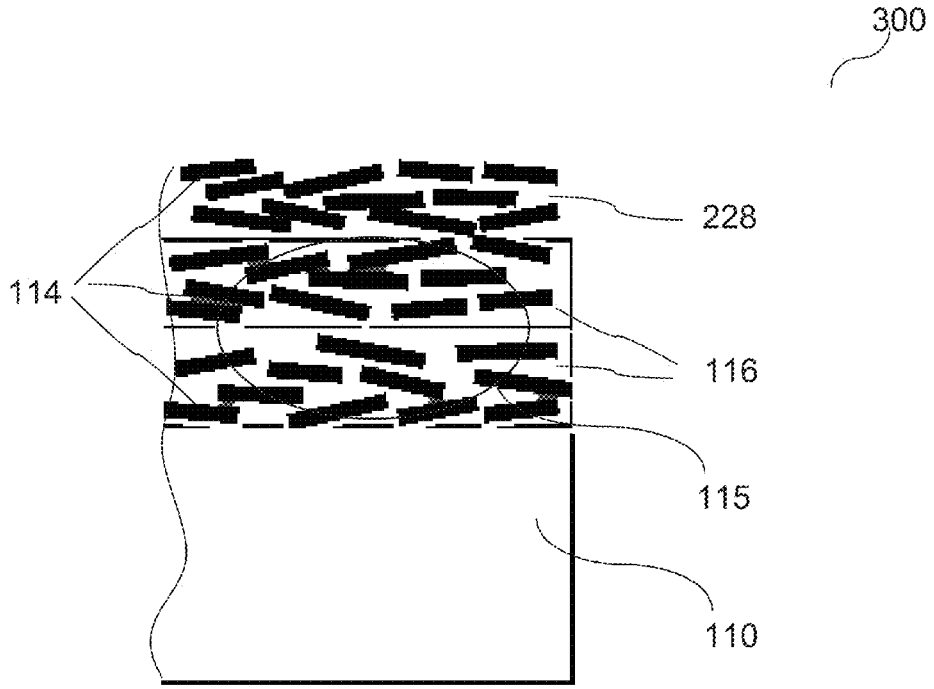
FIGS. 3A and 3B each show a composite material formed using a method of forming a composite material in accordance with various embodiments.
Figure 3B:
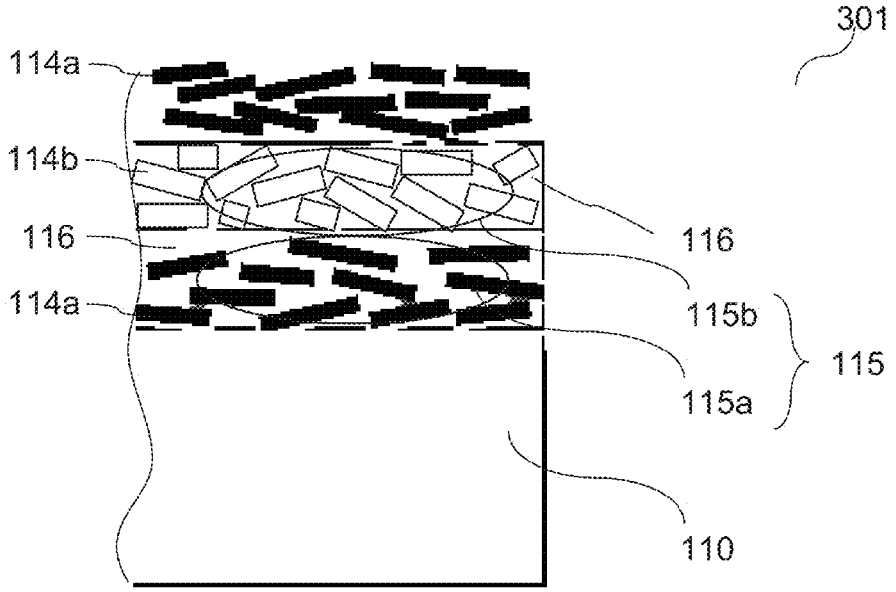

As shown in FIG. 3A and in FIG. 3B, in various embodiments, in order to obtain a thicker structure of the composite material 115, for example a thicker layer, a sequence of the processes of forming a suspension 114, 118 with an essentially homogeneous distribution of particles 114 in the electrolyte 118, of arranging the suspension 114, 118 in physical contact with the carrier 110, of causing the sedimentation of the particles 114 and of electroplating, may be repeated at least once. In this way, a total thickness of the composite material 115 from about 1 μm (e.g. formed from a single execution of the sequence) to about 1 mm (e.g. formed from several executions of the sequence) may be obtained, for example from about 50 μm to about 150 μm.

In various embodiments, the forming of the composite material 115 by means of forming a stack of several individual layers may make it possible to vary the parameters between the individual layers. By way of example, bottom layers (i.e. layers on or near the carrier 110) may include the composite material 115 with spaces 228 essentially filled with the second component 116 of the composite material, and a top layer or top layers (i.e. the one or more layers facing away from the carrier 110) may be formed as a porous layer, for example by means of stopping the electroplating before essentially all the spaces 228 are filled. The remaining spaces 228 may be used for filling the spaces 228 with solder and for forming an electrical connection by means of soldering.

In various embodiments, other parameters than the porosity may be varied between individual layers, for example parameters regarding the first component 114 of the composite material 115. By way of example, the size, shape and/or the composition of the particles 114 may be varied. This is shown in FIG. 3B, in which a composite material 115*a* of a bottom layer may include particles 114*a* of a first component of the composite material 115*a* that are made from a first material. The composite material 115*a* may further include a second component 116 of the composite material 115*a*. A composite material 115*b* of a middle layer may however include particles 114*b* of a first component of the composite material 115*b* made from a second material. The composite material 115*b* may further include a second component 116 of the composite material 115*b*. In a case where the second component 116 may be varied from one layer of composite material 115 to the next, the electrolyte 118 would need to be varied from the formation of the first layer to the formation of the second layer.

In various embodiments, the composite material 115 including several individual layers of composite material 115 may have parameters of the layers chosen such that a desired property of the composite material 115 is obtained, for example a composition, particle size (e.g. fiber thickness and/or fiber length), particle coating, layer thickness and/or layer porosity may be chosen such that the desired electrical conductivity, thermal conductivity, heat capacity etc. may be obtained.

Figure 4:
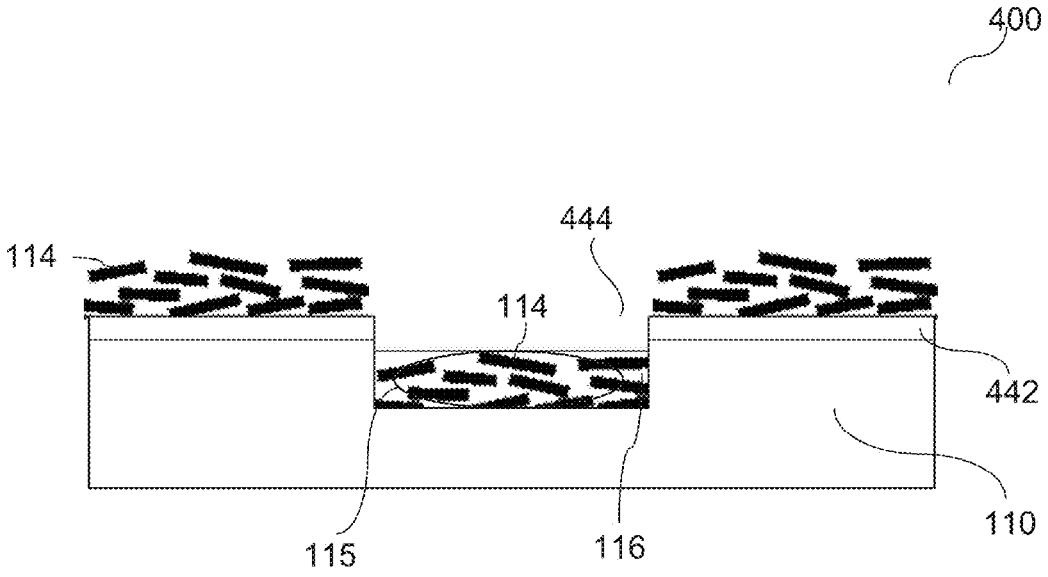
FIG. 4 shows a stage of a method of forming a composite material in accordance with various embodiments.
Figure 5:
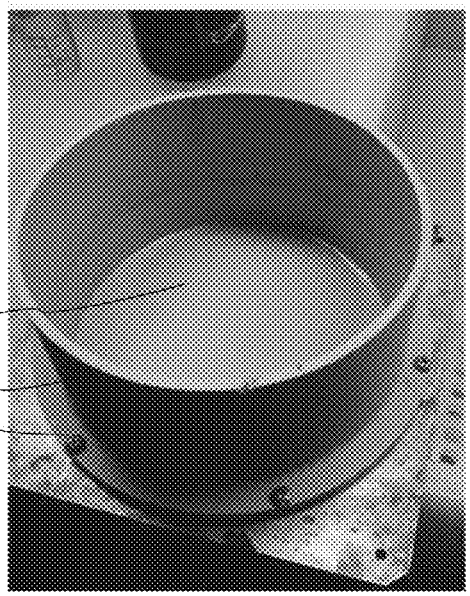
FIG. 5 shows a photograph of an experimental setup for carrying out a method of forming a composite material in accordance with various embodiments, and a photograph of a wafer coated with a composite material obtained through a method of forming a composite material in accordance with various embodiments.
Figure 5:
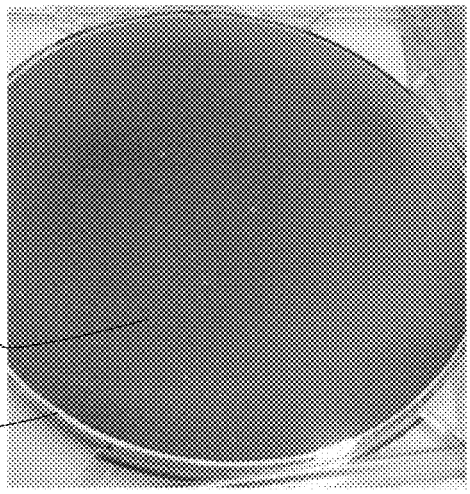

In various embodiments and as shown in FIG. 4, the composite material 115 that may be formed according to the method described in context with the FIGS. 2A to 3B may be structured. For example, the composite material 115 may form a two-dimensional structure on the carrier 110.

In various embodiments, the two-dimensional structure of the composite material 115 may be formed by means of patterning the two-dimensional structure on the carrier 110. By way of example, areas where the composite material 115 may be desired to form, may be left uncoated, such that electrically conductive material (e.g. bare metal) may be exposed to the electrolyte 118 with the particles 114. Other areas where no composite material 115 is supposed to be formed may have a dielectric 442 formed thereon, for example silicon dioxide or any other suitable dielectric. During the electroplating, the second component 116 of the composite material 115 may form only around and or between particles that are in electrical contact with the cathode, i.e. with the uncoated carrier 110. In other words, the composite material 115 may only form in those regions, where the particles 114 are in electrical contact with the cathode. Those particles 114 that may have sedimented onto the dielectric layer may not be in electric contact with the cathode and thus may not be coated. Before a formation of a next layer of composite material on the existing layer of composite material, the particles 114 that had sedimented onto the region where no composite material 115 is supposed to be formed, for example on the regions coated with the dielectric 442, may be removed. For example, they may be stirred into the electrolyte 118 in order to again form a homogeneous distribution of particles 114 within the electrolyte 118, or they may be completely removed from the carrier 110 and/or the container 236, for example together with a removal of the electrolyte 118.

Additionally, the two-dimensional structure may be shaped in the carrier 110, e.g. an opening (e.g. a recess, a hole or a cavity) 444 may be formed in the carrier 110 or a protrusion (e.g. wall) (not shown) may be formed on the carrier 110. In various embodiments, the sedimented particles 114 may be arranged on all surfaces of the carrier 110 facing towards the electrolyte 110, and the composite material 115 may be formed only in regions of the carrier 110 that are pre-defined for a formation of the composite material 115 by leaving them free of a dielectric material 442, e.g. a dielectric coating. In the example shown in FIG. 4, the composite material 115 may be formed only in the opening 444. In the example with the protrusion (e.g. wall) formed on the carrier 110, the composite material may be formed only on the protrusion (e.g. wall).

Figure 6:
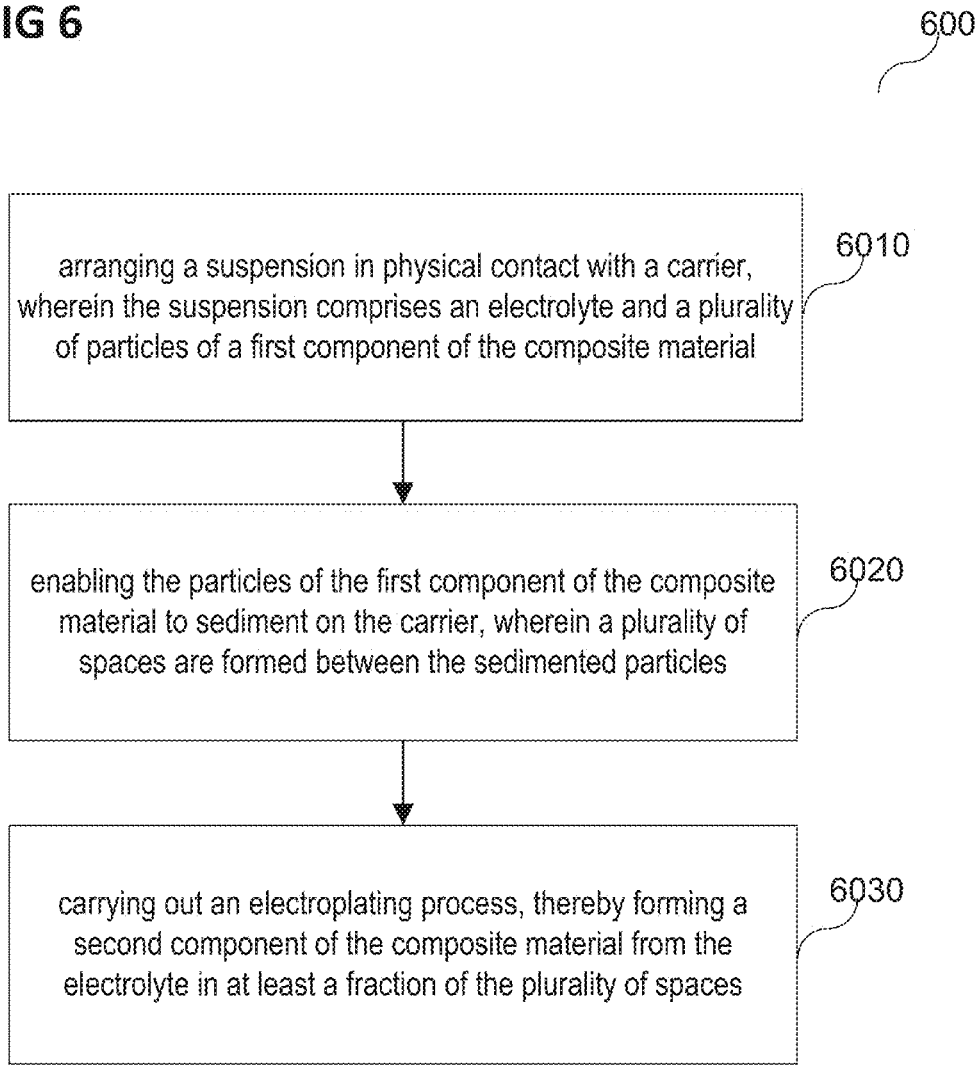
FIG. 6 shows a schematic diagram of a method of forming a composite material in accordance with various embodiments.

FIG. 6 shows a schematic diagram 600 of a method of forming a composite material in accordance with various embodiments.

The method may include arranging a suspension in physical contact with a carrier, wherein the suspension includes an electrolyte and a plurality of particles of a first component of the composite material (in 6010).

It may further include causing the particles of the first component of the composite material to sediment on the carrier, wherein a plurality of spaces are formed between the sedimented particles (in 6020).

It may further include forming by electroplating a second component of the composite material from the electrolyte in at least a fraction of the plurality of spaces (in 6030).

Figure 7:
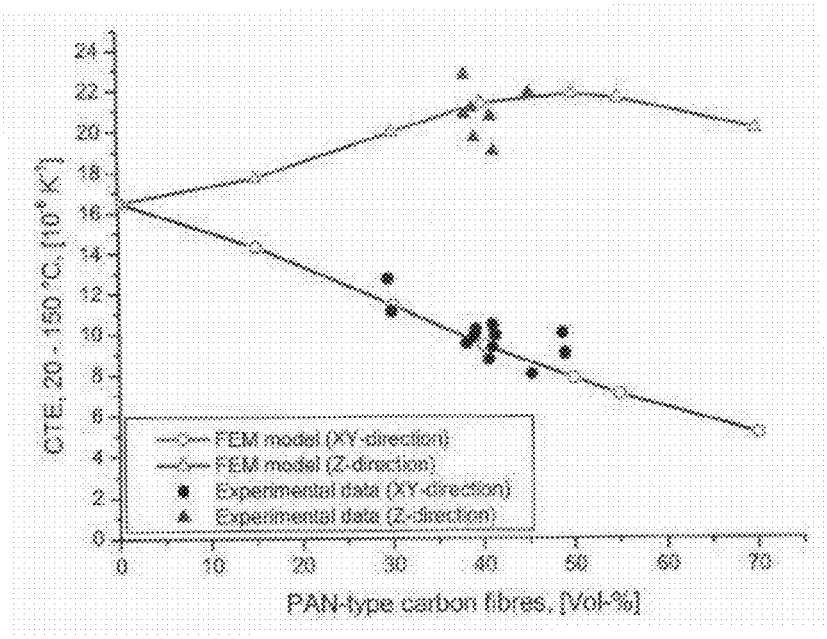
FIG. 7 shows graphs of a coefficient of thermal expansion of a carbon-copper composite material as a function of a percentage of carbon fibers.
Figure 7:
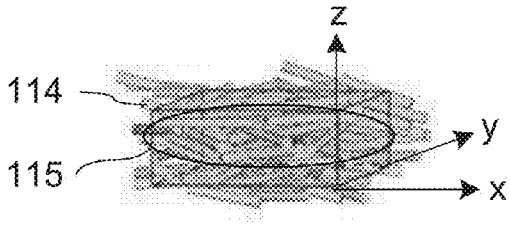
Figure 7:
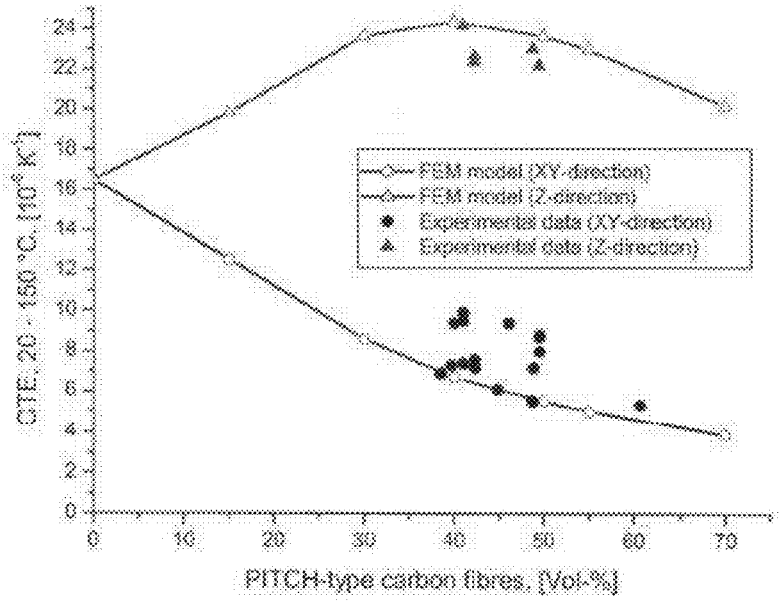

FIG. 7 shows in two graphs 700, 701 how a coefficient of thermal expansion of carbon fibers 114 along their length, which may be low or even negative, may influence the CTE of a composite material 115. In the composite material 115, as shown schematically in a diagram 702 between the two graphs 700, 701, the length of the carbon fibers is predominantly oriented along x and/or y directions, and a thickness of the fibers is predominantly oriented along a z direction. Consequently, the CTE of the composite material 115 may start at a value of around 16.5 $10^{-6}$/K if a volume of the composite material 115 includes 0% of carbon fibers 114 (so-called PAN-type fibers made from polyacrylonitrile in the top graph 700 and so-called pitch-type fibers made from petroleum pitch in the bottom graph 701), and the CTE may drop with increasing percentage of carbon fibers 114 for the xy-direction. In z-direction, the CTE of the carbon fibers 114 may be higher than that of copper, leading to CTE values that are higher than that of pure copper if the volume of the composite material 115 includes more than 0% of carbon fibers 114.

In various embodiments, building up a desired thickness of the composite material 115 from thin layers of composite material 115 may increase (in comparison with building a thick layer of composite material 115 directly) a fraction of carbon fibers 114 that are oriented with their length in x and/or y direction (within an xy-plane). In e.g. FIG. 2A and FIG. 2B, the xy-plane would be parallel to the carrier 110. The xy-plane parallel to the carrier may be the plane where it is desired to match the CTEs of the composite material 115 and of the carrier 110 as closely as possible while respecting other constraints regarding electrical conductivity, thermal conductivity etc., whereas matching the CTEs of the composite material 115 and of the carrier 110 in the z-direction may be less important.

In various embodiments, it may however be important to preserve as much as possible other properties of the composite material 115 (as compared with the pure material, e.g. pure copper), for example electric and/or thermal conductivity, and this may apply to the z-direction as well as to the xy-direction.

As an example for an effect that varying a percentage of carbon fibers 114 in the composite material 115 may have on properties apart from the CTE, a variation of CTE as a function of thermal conductivity is shown in FIG. 8 in two graphs 800, 801. Generally, an increasing percentage of carbon fibers 114 in the composite material (increasing from 0% up to 70% following the plotted lines from top to bottom) may lead to a decrease of CTE in xy-direction, and at the same time to a decrease in thermal conductivity (both in xy and z direction). However, as shown in graph 800, certain types of carbon fibers (e.g. short space grade pitch-type carbon fibers) may not show a decrease in thermal conductivity with decreasing CTE, at least in xy-direction. By selecting an appropriate type of carbon fiber (e.g. with respect to fiber size, material on which the fibers are based, purity etc.) it may therefore be possible to additionally influence the thermal conductivity in the composite material. A similar reasoning may apply to other properties, e.g. to the electrical conductivity etc.

In various embodiments, a method of forming a composite material is provided. The method may include: arranging a suspension in physical contact with a carrier, wherein the suspension may include an electrolyte and a plurality of particles of a first component of the composite material. The method may further include causing the particles of the first component of the composite material to sediment onto the carrier, wherein a plurality of spaces are formed between the sedimented particles, and forming by electroplating a second component of the composite material from the electrolyte in at least a fraction of the plurality of spaces.

In various embodiments, before causing the particles of the first component of the composite material to sediment, the particles of the first component of the composite material may be distributed homogeneously or essentially homogeneously in the electrolyte.

In various embodiments, the second component of the composite material may be a solid material.

In various embodiments, the homogeneous distribution of the particles of the first component of the composite material in the electrolyte may be brought about before the suspension is arranged in physical contact with the carrier.

In various embodiments, the homogeneous distribution of the particles of the first component of the composite material in the electrolyte may be brought about after the suspension is arranged in physical contact with the carrier.

In various embodiments, in which the causing the particles of the first component of the composite material to sediment on the carrier may include allowing the particles to sediment on the carrier by means of gravitational force, the carrier may be arranged under the suspension.

In various embodiments, in which the causing the particles of the first component of the composite material to sediment on the carrier may include allowing the particles to sediment on the carrier by means of buoyancy, the suspension may be arranged under the carrier.

In various embodiments, in which the causing the particles of the first component of the composite material to sediment on the carrier may include applying a centrifugal force to the suspension, such that the particles, following the centrifugal force, may sediment on the carrier, the suspension and the carrier may be arranged side by side.

In various embodiments, the electrolyte may include a metal or metal alloy.

In various embodiments, the electrolyte may include copper.

In various embodiments, the electrolyte may include copper sulfate.

In various embodiments, the second component may include copper.

In various embodiments, the second component may consist of copper.

In various embodiments, the particles of the first component of the composite material may include carbon.

In various embodiments, the particles of the first component of the composite material may consist of carbon.

In various embodiments, the particles of the first component of the composite material may include carbon fibers.

In various embodiments, the carbon fibers may be coated with a metal.

In various embodiments, the metal may include at least one of copper, nickel, chromium, palladium and manganese.

In various embodiments, the carrier may include silicon.

In various embodiments, the carrier may include a wafer.

In various embodiments, the carrier may include a printed circuit board.

In various embodiments, the electroplating may be executed as a continuous formation of the second component of the composite material.

In various embodiments, the electroplating may be executed as a pulsed formation of the second component of the composite material.

In various embodiments, a plurality of layers of the composite material may be formed by means of repeating the method steps of arranging the suspension in physical contact with the carrier, causing the particles of the first component of the composite material to sediment and forming the second component of the composite material by electroplating at least once.

In various embodiments, at least one parameter that is relevant for the forming of the composite material may be varied between an execution of the method and the at least one repetition of the method.

In various embodiments, the at least one parameter may include or may be a material of the particles of the first component of the composite material.

In various embodiments, the at least one parameter may include or may be a size of the particles of the first component of the composite material.

In various embodiments, the at least one parameter may include or may be the electrolyte and a material of the first electrode.

In various embodiments, the plurality of particles of the first component of the composite material may include at least two different types of particles.

In various embodiments, a method of forming a composite material is provided. The method may include arranging a suspension including a copper electrolyte and carbon fibers on a wafer (e.g. silicon wafer), wherein the suspension may be in physical contact with the wafer. The method may further include causing the carbon fibers to sediment on the wafer, wherein a plurality of spaces may be formed between at least some of the carbon fibers; and forming by electroplating copper from the copper electrolyte in at least a fraction of the plurality of spaces.

In various embodiments, an apparatus for forming a composite material on a carrier is provided. The apparatus may include a container. It may further include an electrolyte arranged in the container, wherein the electrolyte may be configured to be in physical contact with the carrier, a homogenizer that may be configured to homogeneously distribute particles of a first component of the composite material in the electrolyte, and a power source that may be configured to supply a voltage to a first electrode and to a second electrode. The first electrode and the second electrode may be arranged to physically contact the electrolyte, the first electrode may include metal, and the second electrode may include the carrier.

In various embodiments, the apparatus may further include a dispenser that may be configured to arrange the electrolyte in the container.

In various embodiments, the homogenizer may include at least one propeller.

In various embodiments, the homogenizer may include at least one jet.

In various embodiments, the homogenizer may be configured to homogeneously distribute the particles of the first component of the composite material in the electrolyte within the dispenser.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

Various aspects of the disclosure are provided for methods, and various aspects of the disclosure are provided for an apparatus. It will be understood that basic properties of the apparatus also hold for the methods and vice versa. Therefore, for sake of brevity, duplicate description of such properties may have been omitted.

What is claimed is:

1. A method of forming a composite material, comprising:

arranging a suspension in physical contact with a carrier, wherein the suspension comprises an electrolyte and a plurality of particles of a first component of the composite material;

causing the particles of the first component of the composite material to sediment on the carrier, wherein a plurality of spaces are formed between the sedimented particles; and forming by electroplating a second component of the composite material from the electrolyte in at least a fraction of the plurality of spaces, wherein the suspension is arranged under the carrier; and wherein causing the particles of the first component of the composite material to sediment on the carrier comprises allowing the particles located below the carrier to sediment on the carrier by means of buoyancy, and wherein the particles of the first component of the composite material comprise carbon fibers and the carbon fibers are coated with a metal.

2. The method of claim 1, wherein, before causing the particles of the first component of the composite material to sediment, the particles of the first component of the composite material are distributed essentially homogeneously in the electrolyte.

3. The method of claim 2, wherein the homogeneous distribution of the particles of the first component of the composite material in the electrolyte is brought about before the suspension is arranged in physical contact with the carrier.

4. The method of claim 2, wherein the homogeneous distribution of the particles of the first component of the composite material in the electrolyte is brought about after the suspension is arranged in physical contact with the carrier.

5. The method of claim 1, wherein the electrolyte comprises a metal or metal alloy.

6. The method of claim 1, wherein the electrolyte comprises copper.

7. The method of claim 1, wherein the carrier comprises a wafer.

8. The method of claim 1, wherein the carrier comprises a printed circuit board.

9. The method of claim 1, wherein the electroplating is executed as a pulsed formation of the second component of the composite material.

10. The method of claim 1, wherein a plurality of layers of the composite material are formed by means of repeating the method steps of arranging the suspension in physical contact with the carrier, causing the particles of the first component of the composite material to sediment and forming the second component of the composite material by electroplating at least once.

11. The method of claim 10, wherein at least one parameter that is relevant for the forming of the composite material is varied between an execution of the method steps and the at least one repetition of the method steps.

12. The method of claim 1, wherein the plurality of particles of the first component of the composite material comprises at least two different types of particles.

13. A method of forming a composite material, comprising:

arranging a suspension comprising a copper electrolyte and carbon fibers on a wafer, wherein the suspension is in physical contact with the wafer;

causing the carbon fibers to sediment on the wafer, wherein a plurality of spaces are formed between at least some of the carbon fibers; and forming by electroplating copper from the copper electrolyte in at least a fraction of the plurality of spaces, wherein the carbon fibers are coated with a metal.

14. A method of forming a composite material, comprising:

arranging a suspension in physical contact with a carrier, wherein the suspension comprises an electrolyte and a plurality of particles of a first component of the composite material;

causing the particles of the first component of the composite material to sediment on the carrier, wherein a plurality of spaces are formed between the sedimented particles; and forming by electroplating a second component of the composite material from the electrolyte in at least a fraction of the plurality of spaces, wherein the plurality of particles are coated with a metal or metal alloy, wherein the plurality of particles are electrically non-conductive, and wherein the plurality of particles are carbon fibers.

* * * * *